US005830033A

United States Patent [19]

Piron

[11] Patent Number: 5,830,033

[45] Date of Patent: Nov. 3, 1998

[54] FOLDING SCENERY CONSTRUCTION

[76] Inventor: David Piron, Rue du Vieux Chaffour 5, B-4841 Henri-Chapelle, Belgium

[21] Appl. No.: 776,096

[22] PCT Filed: May 13, 1996

[86] PCT No.: PCT/EP96/02061

§ 371 Date: Jan. 10, 1997

§ 102(e) Date: Jan. 10, 1997

[87] PCT Pub. No.: WO96/36411

PCT Pub. Date: Nov. 21, 1996

[30] Foreign Application Priority Data

May 18, 1995 [BE] Belgium ..... 9500453

[51] Int. Cl.[6] ..... A63H 33/38; G09F 1/06; B65D 5/56; B65D 5/00

[52] U.S. Cl. ..... 446/150; 446/75; 446/148; 446/487; 40/124.08; 40/530; 206/768; 206/45.28

[58] Field of Search ..... 446/75, 77, 148, 446/150, 152, 478, 487; 40/124.08, 124.09, 530, 531; 206/308.1, 6, 6.1, 759, 762, 45.2, 767, 768, 45.28; 217/57

[56] References Cited

U.S. PATENT DOCUMENTS

| | | | |
|---|---|---|---|
| 391,145 | 10/1888 | Hardin . | |
| 2,317,124 | 4/1943 | Adams . | |
| 2,393,772 | 1/1946 | Herz . | |
| 2,511,211 | 6/1950 | Klein et al. | 206/45.28 |
| 2,609,636 | 9/1952 | Barker | 446/150 |
| 2,880,858 | 4/1959 | Persky | 206/6.1 |
| 3,042,192 | 7/1962 | Herrin | 206/45.19 |
| 3,363,360 | 1/1968 | Ryan | 446/478 |
| 3,783,999 | 1/1974 | Smith | 206/45.23 |
| 4,326,349 | 4/1982 | Daughtry | 40/124.09 |
| 4,397,387 | 8/1983 | Bidegain | 206/45.23 |
| 5,013,278 | 5/1991 | Dixon et al. | 446/73 |
| 5,176,250 | 1/1993 | Cheng | 206/45.13 |
| 5,190,154 | 3/1993 | Reusch | 206/375 |
| 5,317,823 | 6/1994 | Brunt, II | 40/124.08 |
| 5,522,501 | 6/1996 | Luckow | 206/308.1 |
| 5,588,233 | 12/1996 | Volkert et al. | 40/124.08 |
| 5,613,612 | 3/1997 | Davault | 206/768 |

FOREIGN PATENT DOCUMENTS

| | | | |
|---|---|---|---|
| 770219 | 9/1934 | France | 446/148 |
| 3756 | of 1915 | United Kingdom . | |

OTHER PUBLICATIONS

AG Industries, Origami Greeting Cards, Toy Fair, New York City, Feb. 1996.

*Primary Examiner*—Robert A. Hafer
*Assistant Examiner*—Laura Fossum
*Attorney, Agent, or Firm*—Barry R. Lipsitz; Ralph F. Hoppin

[57] ABSTRACT

A sheet has a number of slots laterally defining elements with fold lines extending between said slots. One end of the sheet is attached to the bottom surface of a box and the other end is attached to the inner surface of a lid hinged to the box. The elements can be spatially unfolded, forming at least one plane parallel to one of the said surfaces when it is substantially perpendicular to the other surface, and so that the scenery construction is folded on itself when the lid is swung down on the box.

12 Claims, 4 Drawing Sheets

FOLDING SCENERY CONSTRUCTION

This invention relates to a folding and opening-out three-dimensional scenery construction.

BACKGROUND OF THE INVENTION

The objective is to make folding sceneries that can open out and take shape in different planes in the space. A particular, but nonexclusive, application is a play scenery for children.

SUMMARY OF THE INVENTION

In order to realize this objective, it appeared advantageous to put forward a folding scenery construction comprising a sheet pierced by several slits laterally delimiting elements that exhibit folds extending between the aforesaid slits, one extremity of the aforesaid sheet being attached to a first surface and the opposite extremity of the aforesaid sheet being attached to a second surface in such a way that the aforesaid elements open out in the space forming at least one plane parallel to one of the aforesaid surfaces when this is in a position virtually perpendicular to the other aforesaid surface and in such a way that the scenery construction is folded over on itself when one of the surfaces is folded down on the other surface. The folding construction can be made out of one single piece of a flat sheet of any material. Each opening-out element in the space can have numerous configurations and be freely decorated in order to make any desired scenery.

In an advantageous embodiment, the folding sheet according to the invention is attached both to the bottom of a box and to the inside of a lid that folds down on top of the box. The scenery thus folds up inside the box closed by its lid by the simple shutting of the lid and opens out by raising the lid. The lid is attached to the box via securing means that protect the openings repeated from the lid without risk of tearing the opening-out scenery.

According to another aspect of the invention, the lid comprises two lateral rims and one back rim disposed virtually perpendicular to the plane of the lid in such a way as at least partially to frame the sides and the back of the box when the lid is folded down on the box, the lateral rims of the lid being attached to the sides of the box by securing means passing through them in such a way as to enable the lid to pivot round a imaginary axis defined by the aforesaid securing means.

Owing to the securing device according to the invention, the lid can pivot round the imaginary axis defined by the two securing elements. In its opening movement, the lid carries along and opens out the scenery until it is in raised position. The elements are then opened out in the space. The pivoting movement of the lid is made possible by the elongated form of the openings provided in the sides of the box, which enables the back rim of the lid to skirt round the square edge formed by the junction of the back with the bottom of the box. The pivoting of the lid stops when its back rim comes to rest under and against the bottom of the box. The presence of this back rim holds the lid in its raised position and prevents the tearing of the opened-out scenery.

During its pivoting in the opposite direction, the lid folds down automatically folding the scenery construction into the box. The elements then fold according to the fold lines.

The invention is illustrated in the attached drawings on the basis of which the invention will be described in that which follows.

DETAILED DESCRIPTION OF THE INVENTION

Figure 1:
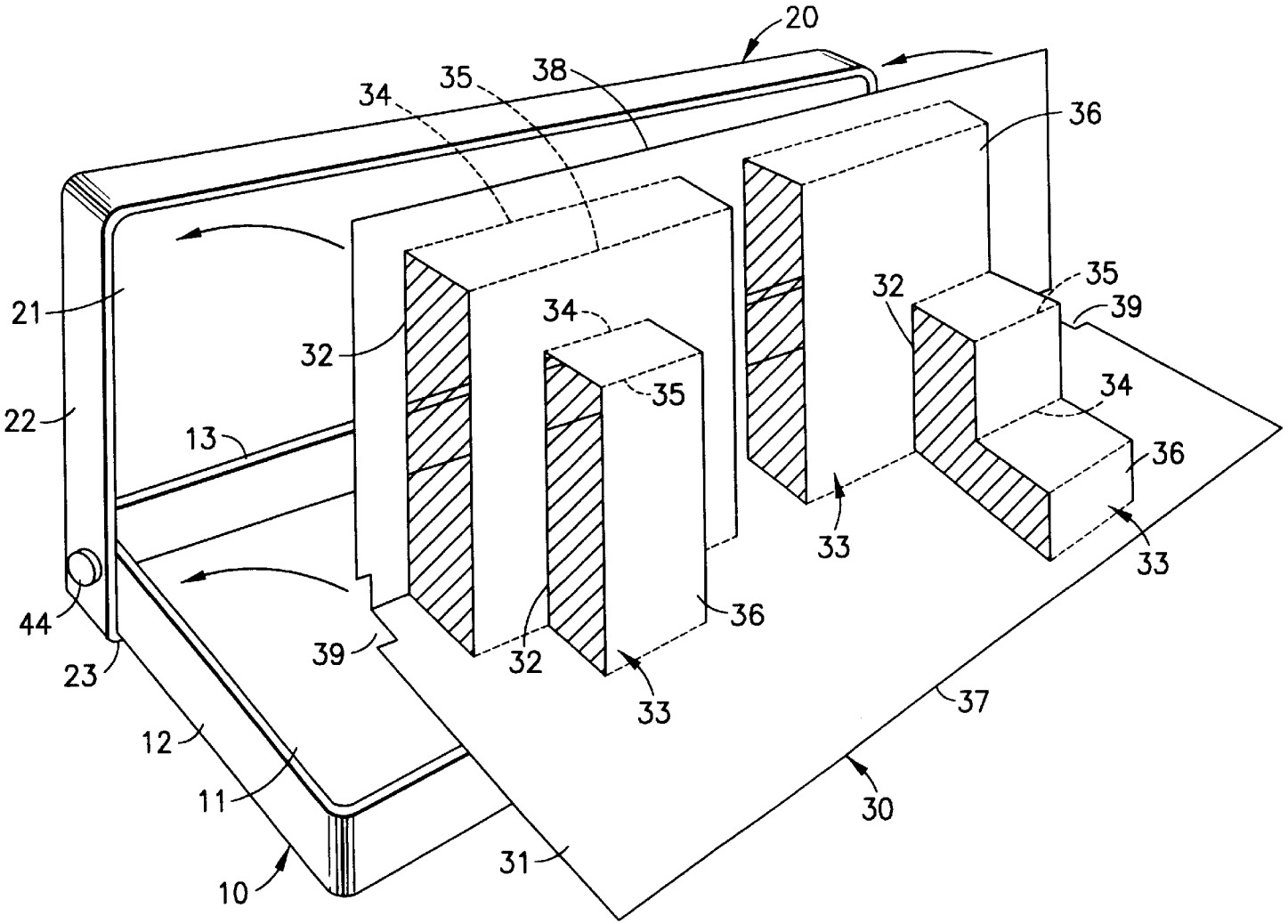
FIG. 1 is a view in perspective of a box according to the invention, with raised lid, schematically showing an opened-out scenery but not yet attached in the box.

With reference to FIG. 1, a box 10 is represented with its lid 20 raised, ready to receive a folding scenery construction in accordance with the invention, schematized in 30. The scenery construction consists of a sheet 31 in which slits 32 are cut. These delimit several opening-out elements 33 which exhibit fold lines 34, 35 extending between two adjacent slits in order to form folds that open in opposite directions. When the sheet 31 is folded virtually at right angles as shown in FIG. 1, the elements 33 are opened out and separate from the bottom 31 forming several parallel planes 36 in the space. Such a scenery, which can be made in a multitude of configurations, appearances and sceneries, is attached to the inside 21 of the lid and to the bottom 11 of the box. The attachment can for example be effected along the longitudinal edges 37 and 38 of the scenery.

Figure 3:
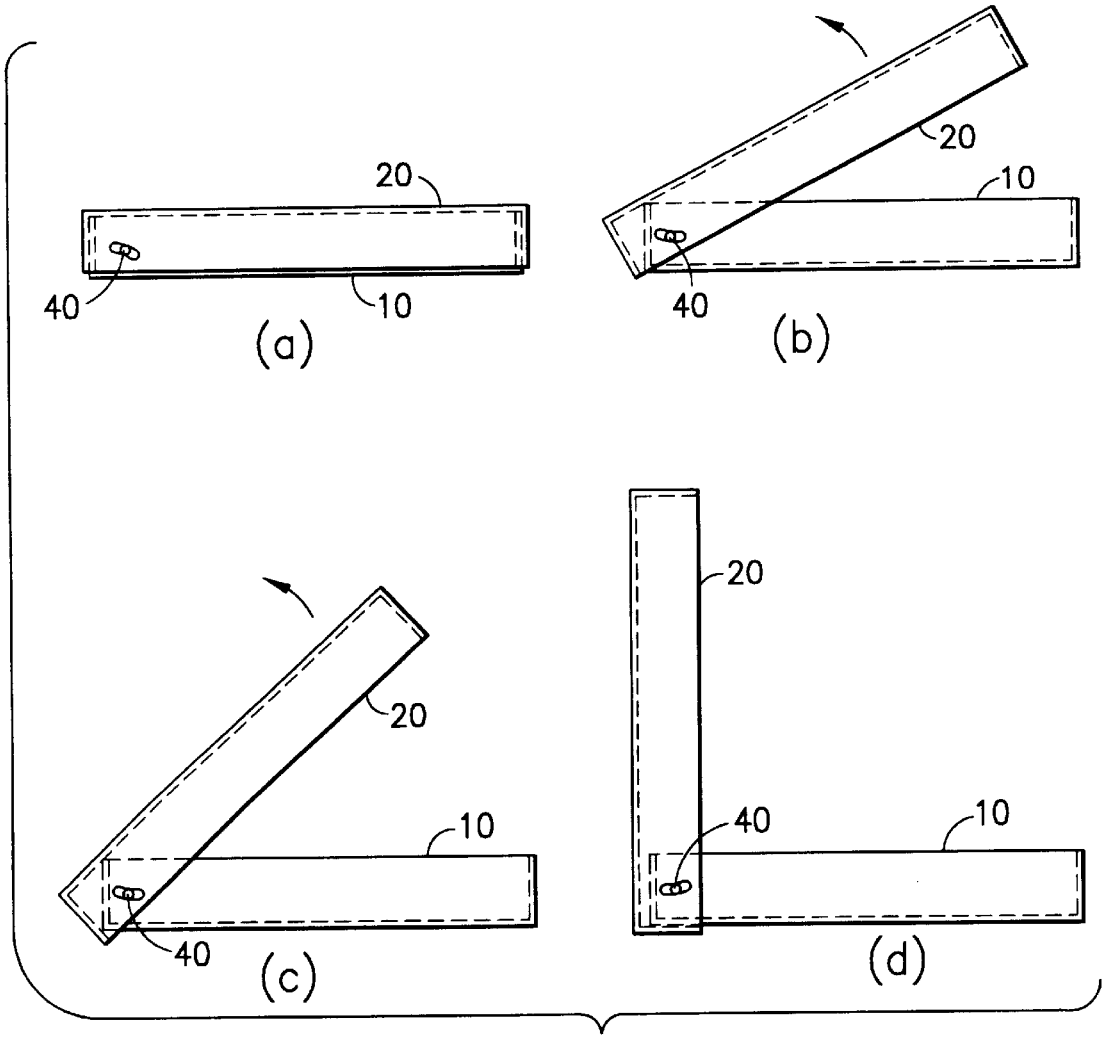
FIG. 3 illustrates the fitting of the box from FIG. 1 into the lid.

The lid 20 is attached to the box 10 in such a way that the lid can be raised into a position virtually perpendicular to the bottom of the box 10 and remain in this position, as illustrated in FIG. 3, without risk of tearing the scenery 30. This objective is achieved, according to the invention, owing to the arrangement described hereafter.

Figure 2:
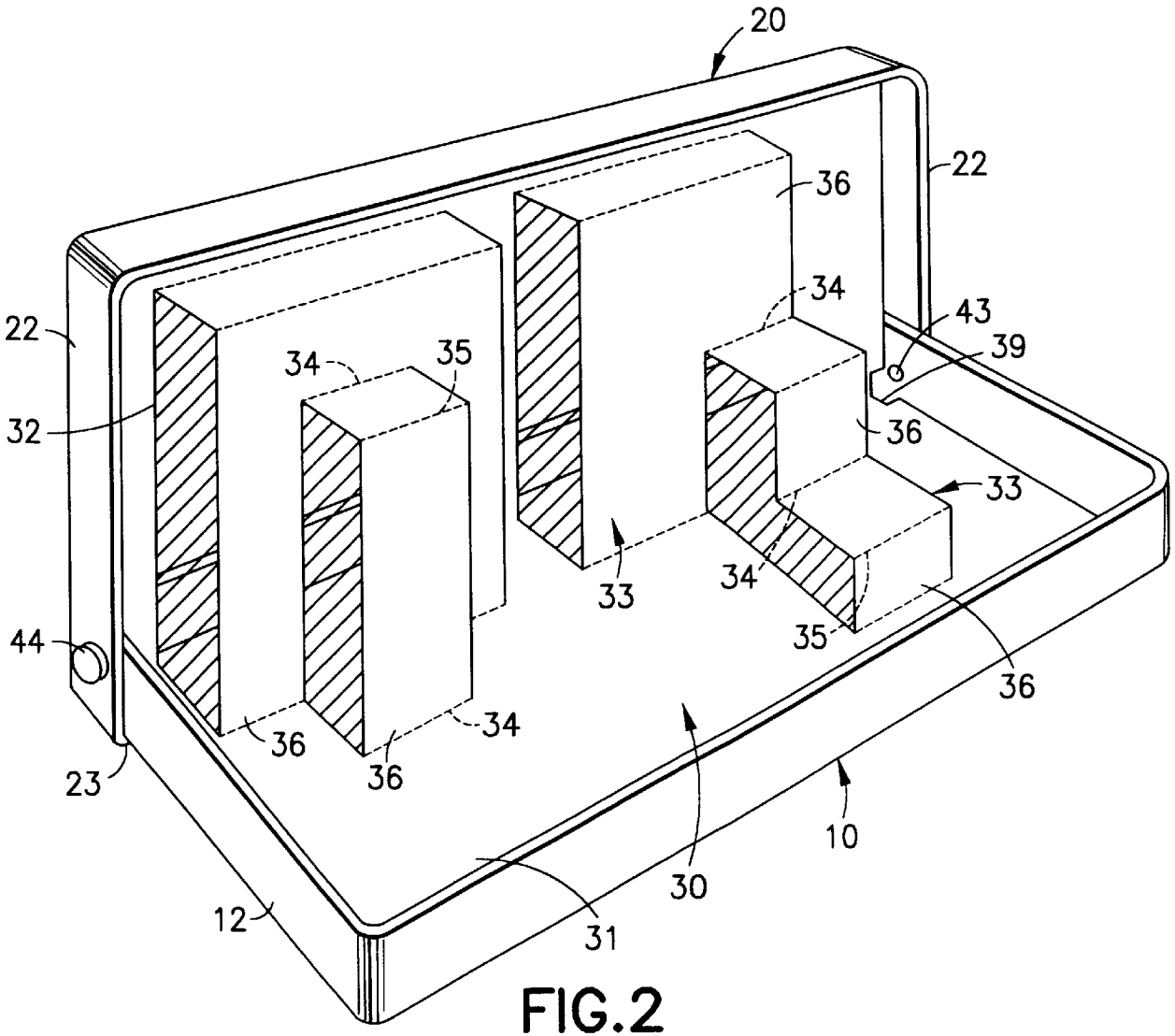
FIG. 2 shows the box from FIG. 1 with the scenery attached and opened out.

The lid 20 exhibits lateral rims 22 which, when the lid is folded down on the top of the box, frames the sides 12 of the box, at least over a part of the width of the box. When the lid 20 is raised as shown in FIG. 2, a part of the aforesaid lateral rims 22 frame a part of the sides 12 of the box 10. It is understood that the lateral rims 22 of the lid can only extend over only a part of the width of the lid. Furthermore, the lid 20 exhibits a back rim 23 which, in the example represented, joins the two lateral rims 22 together. This back rim 23 comes to rest under and against the bottom of the box 10 when the lid is raised. Securing means 40 are disposed in order to attach each lateral rim 22 to one side 12 of the box 10. In FIG. 2, the bottom 31 of the scenery exhibits on its right lateral edge a cut-out 39 in its angle of fold. In the example illustrated, this cut-out enables the back of the scenery that covers the whole length of the lid here to fold without catching on the head 43 of the securing device. A similar cut-out is provided on the left lateral edge (not visible) of the back of the scenery.

Figure 4:
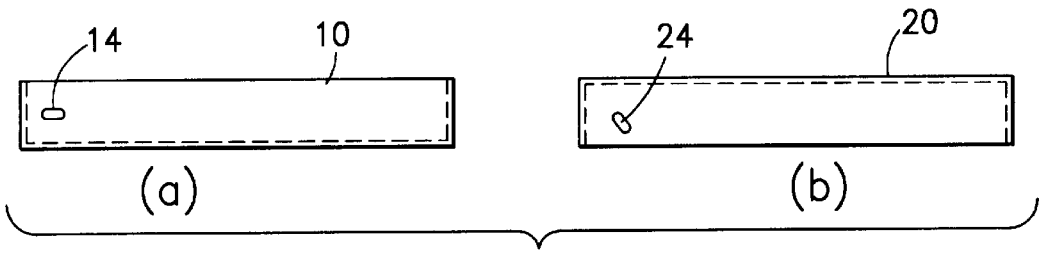
FIG. 4 represents an advantageous embodiment of the box and of its lid.

Each securing means 40 passes through a side 12 of the box 10 in an elongated opening 14 which has its length in the longitudinal direction of the side (see FIG. 4).

Preferably, each securing means 40 passes through a lateral rim 22 of the lid 20 in an elongated opening 24 which has its longitudinal direction oblique in relation to the longitudinal dimension of the lateral rim (see FIG. 4).

Owing to the securing device according to the invention, the lid 20 can pivot round the imaginary axis defined by the two securing elements 40. In its opening movement, the lid 20 carries along and opens out the scenery 30 until it is in raised position as shown in FIG. 2. The elements 33 are then opened out in the space. The pivoting movement of the lid is made possible by the elongated form of the openings provided in the sides of the box 10, which enables the back rim 23 of the lid to skirt round the square edge formed by the junction of the back 13 with the bottom 11 of the box. The pivoting of the lid stops when its back rim 23 comes to rest under and against the bottom of the box. The presence of this back rim 23 holds the lid in its raised position and prevents the tearing of the opened-out scenery 30.

During its pivoting in the opposite direction, the lid 20 folds down automatically folding the scenery construction 30 into the box. The elements 33 then fold according to the fold lines 34, 35.

Figure 5:
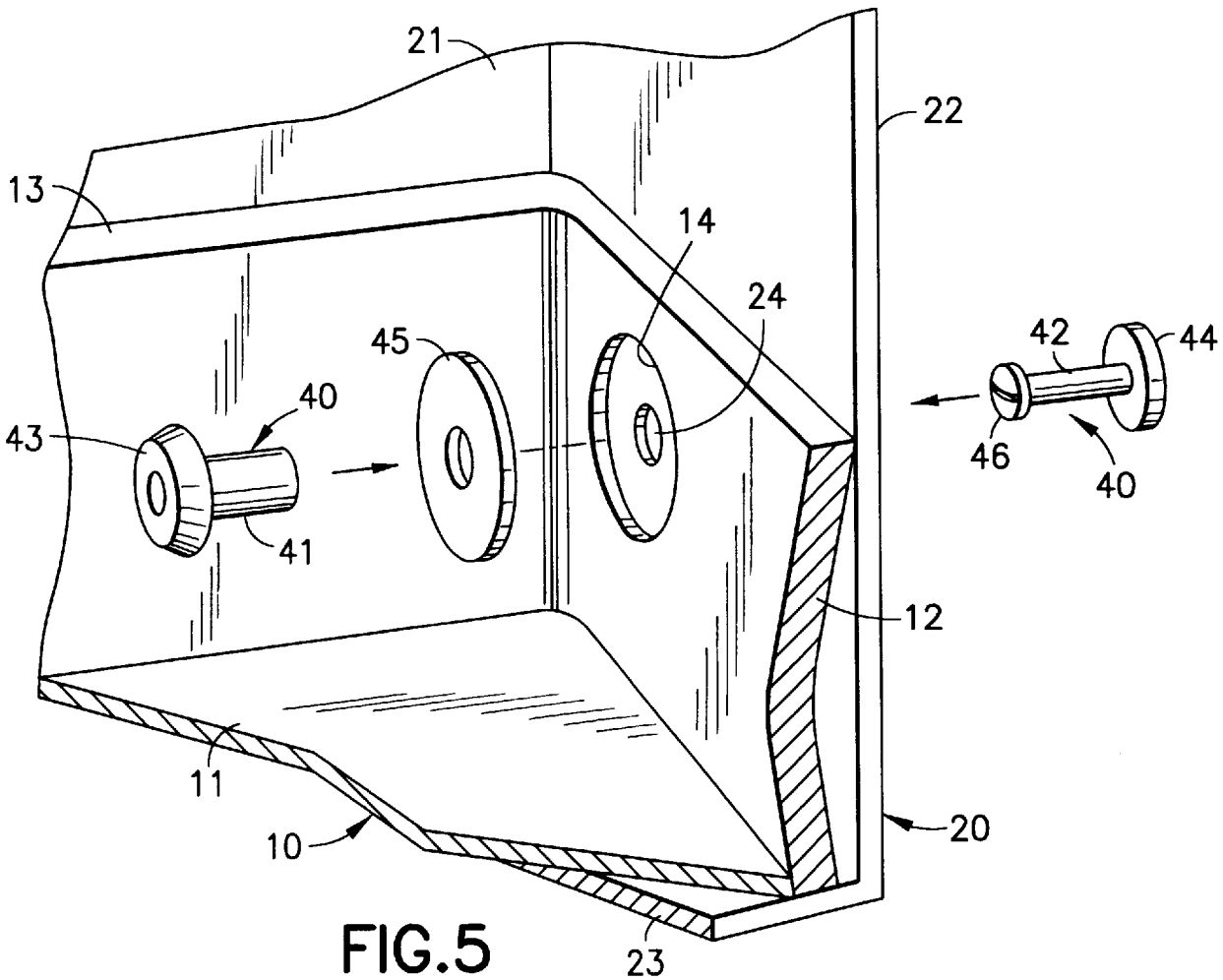
FIG. 5 is an exploded view, on a larger scale, of an example of attachment of the lid to the box shown in FIG. 1.

In the embodiment illustrated in FIG. 5, the connecting part consists for example of two elements 41 and 42 which fit into each other. Each of the two elements exhibits a head, respectively 43 and 44. When the two elements are fitted into each other, the projections of the two heads hold together the unit formed by a side of the box and a lateral rim of the lid, possibly with interposition of a washer 45. Forming one piece of the two elements 41 and 42 with each other can be done simply by clipping the female element 41 onto the connector 46 of the male element 42.

The box can of course serve to contain various useful accessories for using the scenery (installment, record, cassette or other) and for the game.

The embodiment described in the foregoing and illustrated in the attached drawings is an example given as an illustration and the invention is by no means limited to this example. Any modification, any variant and any equivalent disposition must be considered as included in the scope of the invention.

I claim:

1. A folding scenery apparatus, comprising:

a box with a lid rotatably secured thereto;

a fold out scenery construction comprising a sheet pierced by a plurality of slits and having folds, wherein one extremity of said sheet is attached to said lid and an opposite extremity of said sheet is attached to said box;

said box having a bottom surface, and first and second side surfaces which oppose one another and extend substantially perpendicularly from said bottom surface;

said lid having a top surface, and first and second side surfaces which oppose one another and extend substantially perpendicularly from said top surface;

said lid being rotatable only between a closed position and an open position in a continuous delimited range of substantially ninety degrees to prevent tearing of said sheet;

said scenery construction including first and second portions which are adapted to be carried by said box and lid, respectively;

said first and second portions of said scenery construction being positionable in a display position wherein said first and second portions are substantially perpendicular to one another and said lid is in said open position, and in a non-display position wherein said second portion is folded against said first portion and said lid is in said closed position;

first securing means for rotatably securing said first side surface of said box to said first side surface of said lid; and second securing means for rotatably securing said second side surface of said box to said second side surface of said lid; wherein:

when said lid is rotated from said closed position to said open position in said delimited range, a back surface of said lid is adapted to engage underneath said bottom surface to secure said top surface substantially perpendicular to said bottom surface in said open position;

said first and second side surfaces of said box have respective first and second elongated openings which are elongated along a longitudinal direction of said first and second side surfaces of said box;

said first and second elongated openings of said box are adapted to receive said first and second securing means, respectively, and to allow a translational motion of said lid along said longitudinal direction of said box when said lid is rotated from said closed position to said open position;

said first and second side surfaces of said lid have respective first and second elongated openings which are elongated along a direction which is oblique to a longitudinal direction of said first and second side surfaces of said lid; and said first and second elongated openings of said lid are adapted to receive said first and second securing means, respectively, and to allow a translational motion of said lid along said oblique direction of said lid when said lid is rotated from said closed position to said open position.

2. The apparatus of claim 1, wherein:

said slits laterally delimit elements which pop up when said lid is rotated to said open position.

3. The apparatus of claim 2, wherein:

said elements comprise at least one plane which is substantially parallel to said top surface when said lid is in said open position.

4. The apparatus of claim 1, wherein:

said back surface of said lid extends substantially perpendicularly from said top surface.

5. The apparatus of claim 4, wherein:

said back surface of said lid extends substantially at a right angle from said first and second side surfaces of said lid.

6. The apparatus of claim 1, further comprising:

a back surface of said box that extends substantially perpendicularly from said bottom surface.

7. The apparatus of claim 6, wherein said back surface of said box extends substantially at a right angle from said first and second side surfaces of said box.

8. The apparatus of claim 1, wherein:

said first and second securing means define an imaginary axis around which said lid pivots.

9. The apparatus of claim 8, wherein:

said first and second securing means comprise respective first and second shafts having central axes which define said imaginary axis.

10. The apparatus of claim 1, further comprising a back surface of said box that extends substantially perpendicularly from said bottom surface, wherein:

said back surface of said lid extends substantially perpendicularly from said top surface; and said translational motion of said lid in said oblique direction allows said back surface of said lid to rotate freely from said closed position to said open position without said back surface of said lid being impeded by a square edge formed by said bottom surface and said back surface of said box.

11. The apparatus of claim 1, further comprising a back surface of said box that extends substantially perpendicularly from said bottom surface, wherein:

said back surface of said lid extends substantially perpendicularly from said top surface; and said translational motion of said lid in said longitudinal direction of said box allows said back surface of said lid to rotate freely from said closed position to said open position without said back surface of said lid being impeded by a square edge formed by said bottom surface and said back surface of said box.

12. The apparatus of claim 1, wherein:

said first and second securing means each comprise two elements which fit into each other.

* * * * *